US011231686B2

(12) United States Patent
Neighbors

(10) Patent No.: US 11,231,686 B2
(45) Date of Patent: Jan. 25, 2022

(54) WATCH HAVING AN IN INTERCHANGEABLE BEZEL

(71) Applicant: Walter Neighbors, Naples, FL (US)

(72) Inventor: Walter Neighbors, Naples, FL (US)

( * ) Notice: Subject to any disclaimer, the term of this patent is extended or adjusted under 35 U.S.C. 154(b) by 446 days.

(21) Appl. No.: 16/432,109

(22) Filed: Jun. 5, 2019

(65) Prior Publication Data

US 2020/0387113 A1 Dec. 10, 2020

(51) Int. Cl.
*G04B 47/04* (2006.01)
*G04B 19/28* (2006.01)

(52) U.S. Cl.
CPC ..... *G04B 47/046* (2013.01); *G04B 19/283* (2013.01)

(58) Field of Classification Search
CPC ..... G04B 19/283; G04B 47/046
See application file for complete search history.

(56) References Cited

U.S. PATENT DOCUMENTS 5,490,123 A * 2/1996 Biver ..... G04B 47/046 368/294
7,614,785 B2 * 11/2009 Hiranuma ..... G04B 19/283 368/294
8,272,778 B2 * 9/2012 Hiranuma ..... G04B 19/286 368/295
9,501,037 B2 * 11/2016 Silvant ..... G04B 19/283
11,150,606 B2 * 10/2021 Loetscher ..... G04B 3/043
2006/0114753 A1 * 6/2006 Gerber ..... G04B 45/0092 368/295
2008/0285391 A1 * 11/2008 Hiranuma ..... G04B 19/283 368/295
2016/0109853 A1 * 4/2016 Kobayashi ..... G04B 19/22 368/295
2019/0187619 A1 * 6/2019 Wahler ..... G04B 47/046

* cited by examiner

*Primary Examiner* — Edwin A. Leon
*Assistant Examiner* — Jason M Collins

(57) ABSTRACT

The watch bezel system includes a bezel that is removable and replaceable with another bezel. The bezel is removed by pushing a button on the side of the watch case that retracts a pin residing in the case of the watch. At the same time, the user grasps the bezel with their other hand and twists the bezel clockwise and pulls the bezel away from the case of the watch. The replacement of the bezel is done by aligning the interlocking mechanism of the bezel with the interlocking mechanism of the case of the watch, then pushing the bezel against the case, and twisting counterclockwise. The bezel will self-lock in place with the pin attached to the case. When the button is released, the pin will automatically enter a recess in a slot in the bezel, locking the bezel in place, and keep the bezel from rotating or coming off the watch case. Additionally, the interlocking mechanisms on the case and bezel also keep the bezel from coming off the watch case. The pin is engaged and disengaged with the push button on the side of the case of the watch.

15 Claims, 4 Drawing Sheets

WATCH HAVING AN IN INTERCHANGEABLE BEZEL

BACKGROUND OF THE INVENTION

The present invention is related to a watch including a case and an interlocking watch bezel system. The watch bezel system includes a bezel that is removable and replaceable with another bezel. The bezel is removed by pushing a button on the side of the watch case that retracts a pin residing in the case of the watch. At the same time, the user grasps the bezel with their other hand and twists the bezel clockwise and pulls the bezel away from the case of the watch. The replacement of the bezel is done by depressing the button on the side of the case, aligning the interlocking mechanisms of the bezel with the interlocking mechanism on the case of the watch, then pushing the bezel against the case, and twisting counterclockwise. The bezel will self-lock in place with the pin attached to the case. When the button is released, the pin will automatically enter a recess in a slot in the bezel, locking the bezel in place, and keep the bezel from rotating or coming off the watch case. This pin is engaged and disengaged with the push button on the side of the case of the watch.

Patent CH-A-118 038 describes a watch case forming an outer envelope intended to receive a movement. The outer envelope is made of a back cover/casing and a bezel. In order to avoid the usual arrangement of a screw thread coupling them together, the use of a bayonet joint is provided, to separate and reunite the back cover/casing with the bezel. In order to attain this purpose, the bezel bears studs intended to fit into grooves formed in the back cover/casing. This latter bears springs which project to the internal end of the grooves and behind which are engaged the studs having come to the end of the travel in such grooves. In this construction, it is sufficient to give the bezel an inverse rotational movement in order to disengage the bezel from the back cover/case-band. This system thus does not exhibit the safety arrangement preventing an untimely rotational movement which could accidentally come to free the movement.

U.S. Pat. No. 5,490,123 granted to Biver discloses a watch case that includes a detachable bezel with a bayonet member that is moved vertically to interlock the bezel onto a caseband. A spike shaped blocking means is provided that is interposed between the bezel and the caseband when a predetermined rotation has been affected between the watch and the bezel to prevent any further rotational movement of the bezel. A grasping member is also disclosed to enable retraction of the vertically disposed blocking means to disengage the bezel from the caseband by rotation and then translational movement.

SUMMARY OF THE INVENTION

The detachable bezel of the present invention seeks to attain a simplified and secure retention of the interchangeable bezel on the watch face. The combination of features of the invention includes a safety arrangement preventing relative movement between the watch face and the bezel thus preventing untimely disengagement of the bezel. The watch face includes a plurality of raised projections that are received in complementary recesses located on the bottom surface of the bezel. The watch face of the present invention is also characterized by the fact that it includes a laterally moving locking post that is engaged in a locking slot on the bezel when a predetermined rotation angle has been affected by the bezel relative to the watch face. These features are designed to prevent the rotational movement of the bezel relative to the watch face while allowing quick and easy interchangeability of the bezel. The movement of the locking post is affected by movement of a depressible button on the side of the watch face to enable lateral movement of the locking post from the locking slot. The depression of the locking post enables the initial rotation of the bezel relative to the watch casing and then allows the disengagement of the bezel from the watch face by relative rotation to release the projections on the watch face and recesses on the bezel. The bezel and watch case also include further interlocking mechanisms to retain the bezel on the watch case.

The design may be produced in Stainless steel, gold, platinum, titanium, bronze, tantalum, magnesium, carbon fiber, ceramics, sapphire, aluminum, and any other appropriate metal, alloy, or ceramic material. The bezels are produced in materials that are physically able to sustain the design and are available in a variety of colors in the Pantone color pallet and custom colors.

The purpose of this device is to enable the owner of the watch to use a variety of different bezels in a variety of materials and colors to suit their needs, tastes and preferences, thus having the ability to change the look and style of their watch anytime they wish.

The invention is now to be explained by the description of an embodiment given by way of example which description is illustrated by the drawings.

DESCRIPTION OF THE PREFERRED EMBODIMENT

Figure 1:
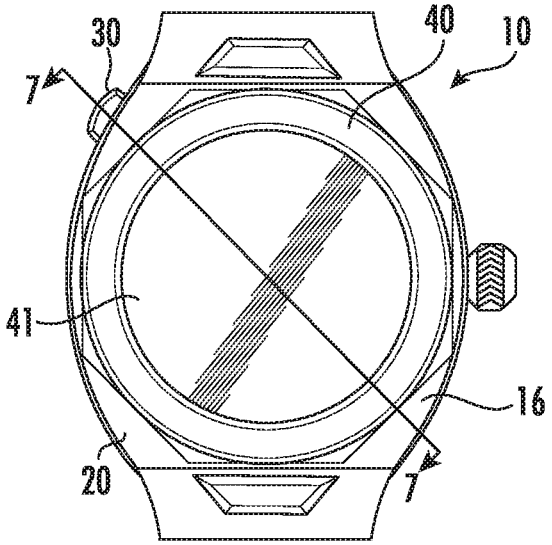
FIG. 1 is a plan view from above of the watch according to the invention.
Figure 2:
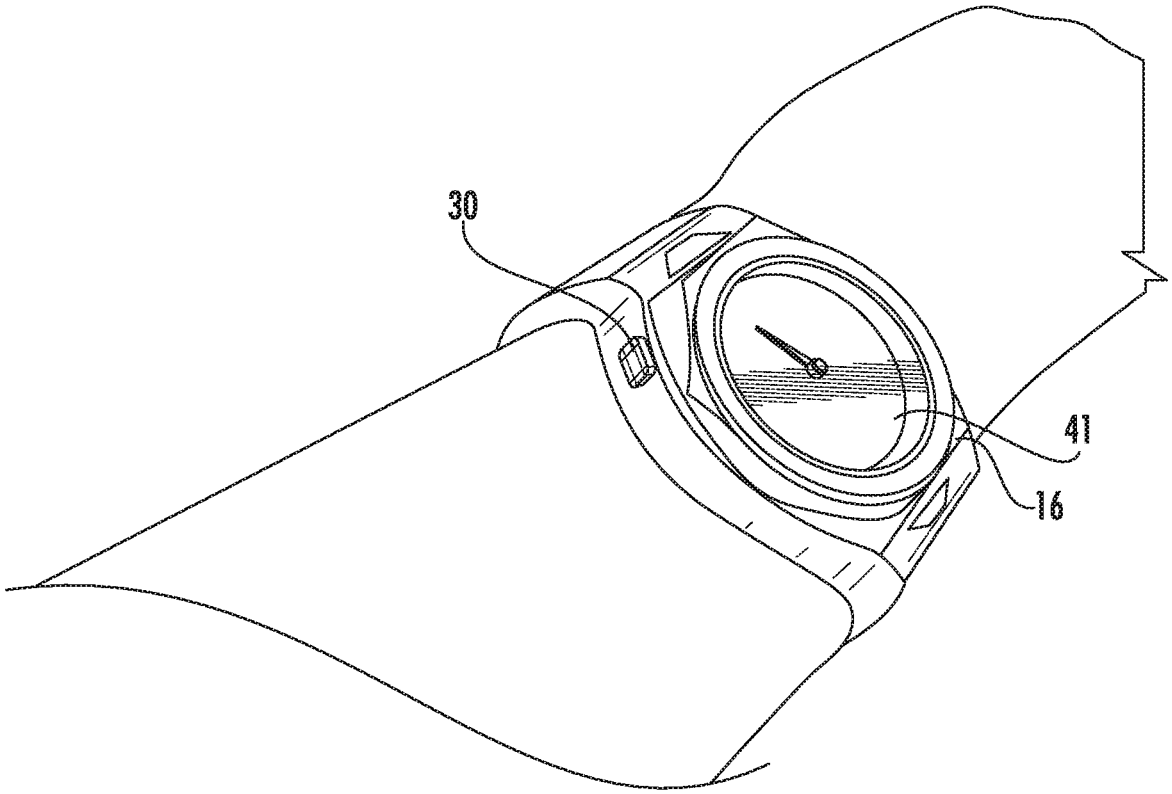
FIG. 2 is a perspective view from above of the watch shown in FIG. 1.

As generally shown the in Figures, the watch 10 includes a watch case 20 and bezel 40 formed in two parts that are releasably fitted into one another. As used generally herein, "inwardly" is generally meant to refer to a direction towards the center of the circular member such as the watch case 20 or bezel 40 and the term "outwardly" generally refers to a direction towards the periphery or circumference of the circular member such as the watch case 20 or bezel 40. The crystal 41 located on the watch case 20 is fitted into the bezel 40 of the watch 10. The detachable bezel 40 is attached to the top surface 16 of the watch case 20 and the crystal 41 protects the watch movement components and the surface of the watch case 20. The watch case 20 is also closed by a back cover fixed on the watch 10 and includes side extensions for a watch band. A packing or similar conventional arrangement assures water resistance of the back cover. It will be noted that back cover could be integrally formed with the watch case 20, thus rendering superfluous use of the packing.

Figure 4:
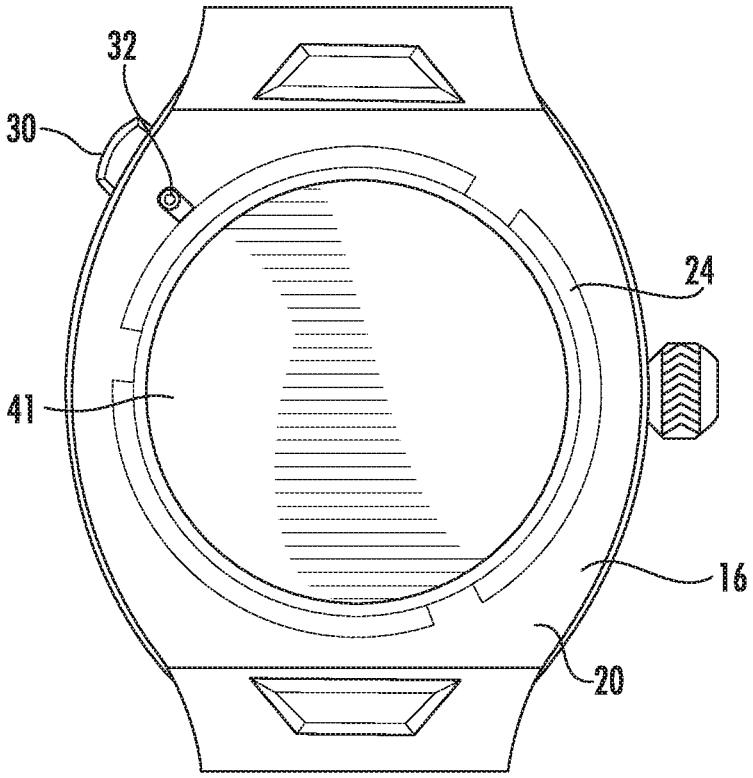
FIG. 4 is a plan view from above of the watch case shown in FIG. 1.
Figure 5:
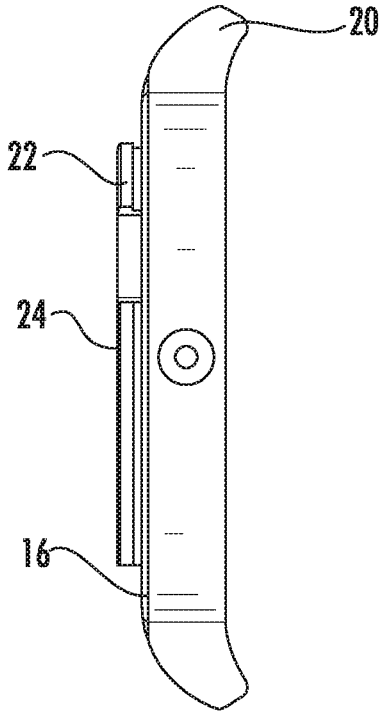
FIG. 5 is a side view of the watch case shown in FIG. 1.

As shown in FIGS. 4 and 5, The top or face surface 16 of the watch case 20 includes a plurality of raised interlocking members 24. These raised interlocking members include lip surfaces 22 that extend outwardly from the outer circumference of the raised interlocking members a sufficient distance to engage the recessed interlocking members 44 on the inner surface of the bezel 40 described below. The watch case 20 also includes a depressible button member 30 extending from the side surface thereof. The button member 30 is preferably spring biased outwardly in communication with the locking post member 32. As shown, the locking post 32 extends upwardly to engage a recess located in the bottom surface of the bezel 40. Depression of the button member 30 presses against the spring member 34 and causes the lateral movement of the locking post 32 towards the interior of the bezel 40. The movement of the locking post 32 towards the interior of the bezel 40 causes the locking post 32 to release from a locking recess 54 located on the interior and bottom surface of the bezel 40. When the button member 30 is released, the spring causes the button member 30 to move outwardly away from the interior of the bezel 40 and into engagement with the locking recess 54 on the bezel 40.

Figure 6:
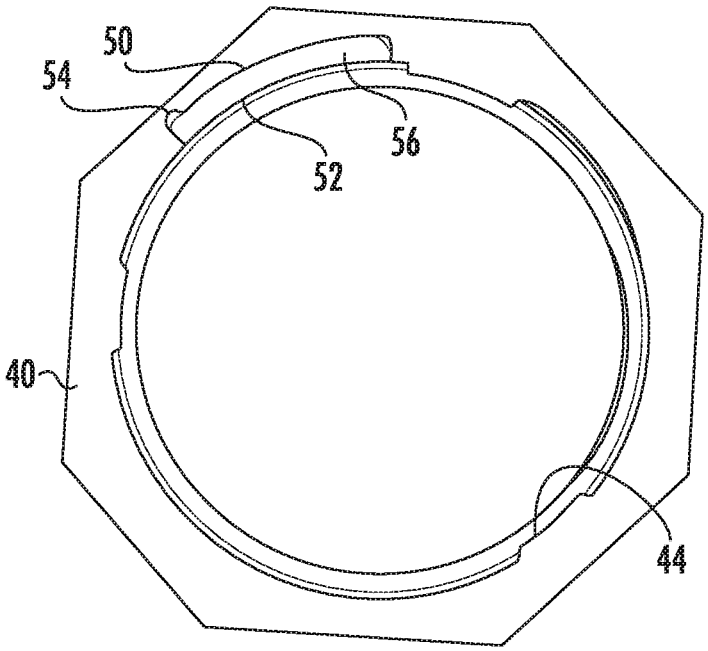
FIG. 6 is a bottom view of the bezel of FIG. 1.
Figure 7:
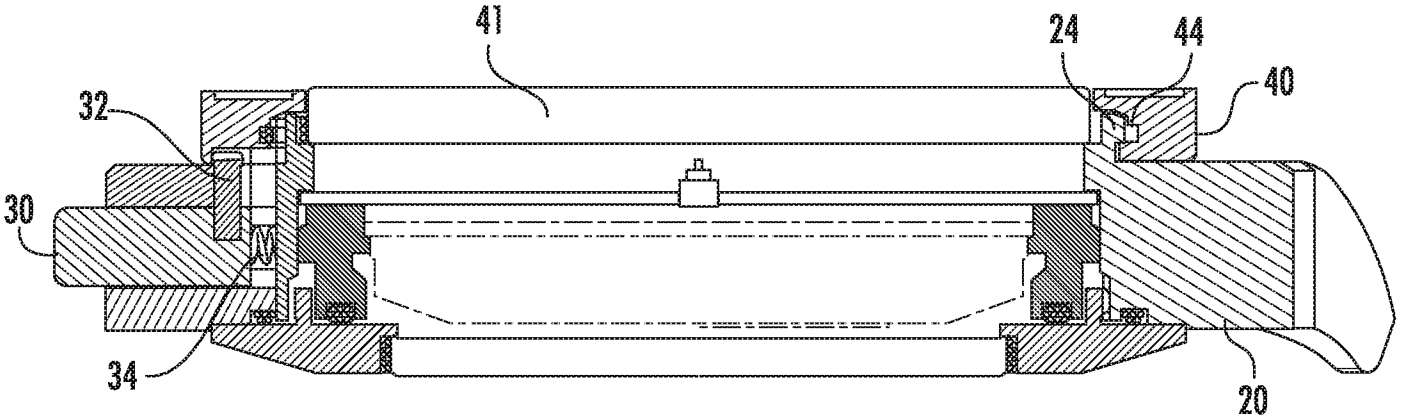
FIG. 7 is a cross-section along line 7-7 of FIG. 1 showing the raised projections on the watch case and recess on the bezel engaged.
Figure 8:
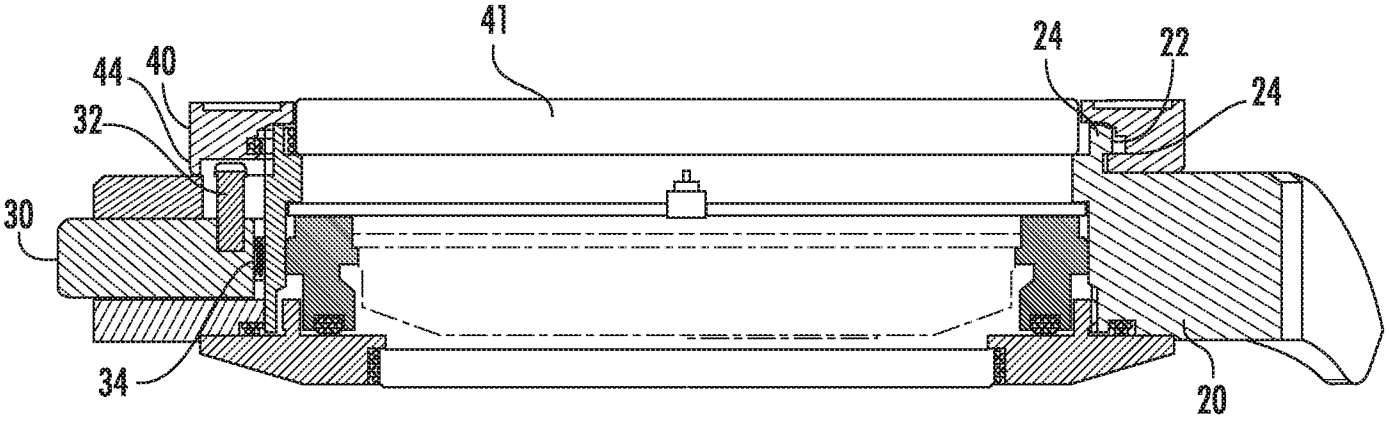
FIG. 8 is a cross-section along line 7-7 of FIG. 1 showing the locking post on the watch case and locking recess on the bezel disengaged.

FIGS. 6-8 show the bezel 40 with the recessed interlocking members 44. The recessed interlocking members 44 cooperate with raised interlocking members 24 extending from the face 16 of the watch case 20. The raised interlocking members 24 include an outwardly extending lip surface 22 to engage the complementary surfaces on the recessed interlocking members 44. The cooperation between the raised interlocking members 24 and the outwardly extending lip surfaces 22 with the recessed interlocking members 44 assure axial retention of the bezel 40 onto the watch case 20 when the bezel 40 is given a rotational movement relative to the watch case 20.

Figure 3:
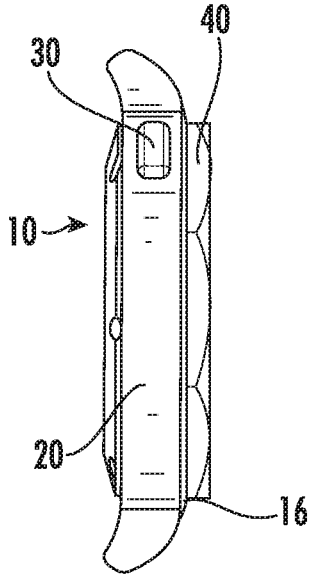
FIG. 3 is a side view of the watch shown in FIG. 1.

The invention also includes the feature of a rotational blocking feature interposed between bezel 40 and watch case 20 when a predetermined rotation angle has been affected by the bezel, thus preventing additional rotational movement of the bezel 40 relative to the watch case 20. The blocking feature is shown in FIGS. 3, 5 and 7 and generally consists of a lip or edge surface at the end of the recessed interlocking members 44 to prevent further rotational movement. Although the present embodiment is illustrated with the complementary interlocking members, it is anticipated that a pair of grooves and extensions or threads also may be used along the periphery of the bezel to allow rotational movement and retention therebetween.

As shown in FIG. 6, the bezel 40 further includes a locking recess 50. The locking recess 50 consists of an elongate slot portion 52 which is located generally adjacent a portion of the interior surface of the bezel 40 and an enlarged locking slot 54 located at one end of the locking recess 50 and an entry slot 56. The locking slot 54 is sized to receive and retain the locking post member 32 therein when the button is released. When the button is depressed, the locking post member 32 moves inwardly from the locking slot 54 into the elongate portion 52 of the locking recess 50. When the locking post member 32 is depressed, the bezel may be rotated clockwise to allow the locking post member to pass through the elongate slot portion 52 to the entry slot 56 thereof that is open to the interior of the bezel and, in combination with the interlocking members, allows the bezel 40 to be removed from the watch case 20.

The insertion of the bezel 40 onto the watch case 20 includes the initial step of aligning the bottom surface of the bezel 40 with the top surface of the watch case such that the raised interlocking members 24 are aligned to fit within the recessed interlocking members 44. The bezel 40 is then pressed onto the watch case 20 and rotated clockwise to allow the raised interlocking members to rotate into the recessed interlocking members. In one form of this invention, this process is similar to threading the bezel 40 onto the watch case 20. This counterclockwise rotation also causes the locking post member 32 to rotate from the entry slot 56 of the locking recess 50, through the elongate slot portion 52 and into the locking slot 54. When the button member 30 is not actuated, the spring force causes the post member 32 to be biased outwardly and laterally such that it moves into and is captured in the locking slot 54 as shown in FIG. 7. When the button member 30 is depressed or actuated, the post member 32 is moved inwardly to be removed from the locking slot 54 as shown in FIG. 8. Further counterclockwise rotation of the bezel 40 with respect to the watch case 20, causes the post member 32 to move through the elongate slot portion 52 and into the entry slot portion 56 of the locking recess 50. This rotational movement of the bezel 40 with respect to the watch case 20 also causes the raised interlocking members to rotate with respect to the recessed interlocking members to release the raised interlocking members from the recessed interlocking members to allow for the removal of the bezel from the watch case.

What I claim is:

1. A watch comprising;

a watch case having a top surface and a back cover; and a detachable bezel removably engaging the top surface of the watch case, and wherein the bezel and watch case are interlockable, and with the watch case serving for axial retention of said bezel on said watch case when the bezel is given a rotational movement relative to the watch case, and further including a laterally movable locking post on the watch case and a locking recess on a bottom surface of the bezel to prevent the movement of the bezel relative to the watch case when a predetermined rotation angle has been affected by the bezel for preventing removal of said bezel from said watch case, said locking post being movably mounted in said watch case and including a manually movable button enabling lateral movement of said locking post between engagement in the locking recess and disengagement of the bezel from the watch case by depression of said button and then translation of said bezel relative to the watch case.

2. The watch as set forth in claim 1, wherein said locking post extends upwardly from the top surface of the watch case and is oriented to enter and then engage a locking slot in the locking recess of the bezel.

3. The watch as set forth in claim 2, wherein the bezel and the watch case each include innerperiphery and outer periphery areas and bear a plurality of complementary raised projections and recessions along their inner periphery and said projections and recessions being arranged to complementarily engage each other upon rotation of the bezel relative to the watch case.

4. The watch as set forth in claim 1, the bezel and the watch case each include inner periphery and outer periphery areas and bear a plurality of complementary raised projections and recessions along their inner periphery and said projections and recessions being arranged to complementarily engage each other upon rotation of the bezel relative to the watch case.

5. The watch as set forth in claim 4 wherein rotational engagement of the raised projections and recessions by rotating the bezel relative to the watch case causes the locking post to travel from an entry portion of the locking recess into an elongate slot portion of the locking recess and further rotation of the bezel relative to the watch case causes the locking post to enter into the locking slot of the locking recess.

6. The watch as set forth in claim 1 wherein the watch case includes a depressible button thereon and said button causes the lateral movement of the locking post relative to the locking recess of the bezel.

7. The watch as set forth in claim 6 wherein the button is movable between first and second positions and is biased in the first position wherein the locking post is engageable in the locking slot of the locking recess and movable to the second position wherein the locking post is releasable from the locking slot of the locking recess.

8. A watch comprising;

a watch case having a back surface and a top surface; and a detachable bezel removably engaging the watch case and wherein the bezel and watch case are interlockable, and with the watch case serving for axial retention of said bezel on said watch case when the bezel is given a rotational movement relative to the watch case, and further including a laterally movable locking post on the watch case and a locking recess on a bottom surface of the bezel to prevent the movement of the bezel relative to the watch case when a predetermined rotation angle has been affected by the bezel for preventing removal of said bezel from said watch case, said locking post being movably mounted in said watch case and including a manually movable button enabling lateral movement of said locking post between a first position wherein the locking post is engageable in the locking recess and a second position wherein the locking post is disengageable from the locking recess of the bezel.

9. The watch of claim 8 wherein the button is biased in the first position and movable to the second position by depressing the button and wherein the watch case includes a side surface having the button thereon.

10. The watch as set forth in claim 8, wherein said locking post extends upwardly from a top surface of the watch case and is oriented to enter into and then engage a locking slot in the locking recess.

11. The watch as set forth in claim 8, wherein the bezel and the watch case each include inner periphery and outer periphery areas and bear a plurality of complementary raised projections and recessions along their inner periphery and said projections and recessions being arranged to complementarily engage each other upon rotation of the bezel relative to the watch case.

12. The watch as set forth in claim 11 wherein rotational engagement of the raised projections and recessions by rotating the bezel relative to the watch case causes the locking post to travel into an entry portion of the locking recess and further rotational movement of the bezel relative to the watch case causes the locking post to enter into a locking slot in the locking recess.

13. A watch comprising;

a watch case having a bottom surface, a side surface and a top surface;

a detachable bezel having a bottom surface and is oriented to removably engaging the watch case and wherein the bezel and watch case are interlockable, and with the watch case serving for axial retention of said bezel on said watch case when the bezel is given a rotational movement relative to the watch case, and further including a laterally movable locking post on the watch case and a locking recess on a bottom surface of the bezel to prevent the movement of the bezel relative to the watch case when a predetermined rotation angle has been affected by the bezel for preventing removal of said bezel from said watch case, said locking post being movably mounted in said watch case and including a manually movable button on said side surface of said watch case for enabling lateral movement of said locking post between a first position wherein the locking post is engageable in the locking recess and a second position wherein the locking post is disengageable from the locking slot of the bezel;

wherein the button on the side surface of the watch case is biased in the first position and is movable to the second position by depressing the button;

wherein said locking post extends upwardly from the top surface of the watch case and is oriented to enter and then engage a locking slot in the locking recess; and wherein the bezel and the watch case each include inner periphery and outer periphery areas and bear a plurality of complementary raised projections and recessions along their innerperiphery and said projections and recessions being arranged to complementarily engage each other upon rotation of the bezel relative to the watch case.

14. The watch as set forth in claim 13 wherein rotational engagement of the raised projections and recessions by rotating the bezel clockwise relative to the watch case causes the locking post to travel from an entry portion in the locking recess, through an elongate slot portion and into the locking slot of the locking recess.

15. The watch as set forth in claim 13 wherein the locking slot on the bezel includes an entry slot and a locking slot and depression of the button causes the locking post to be movable from the locking slot in the locking recess to an elongate slot portion and to the entry portion of the locking slot upon counter-clockwise movement of the bezel with respect to the watch case.

* * * * *